US007727020B2

(12) United States Patent
Gladd et al.

(10) Patent No.: US 7,727,020 B2
(45) Date of Patent: Jun. 1, 2010

(54) CABLE CONNECTOR

(75) Inventors: Joseph Howard Gladd, Cortland, OH (US); Leslie L. Jones, Garrettsville, OH (US); William C. Ketterer, Girard, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 12/231,724

(22) Filed: Sep. 5, 2008

(65) Prior Publication Data

US 2010/0062631 A1 Mar. 11, 2010

(51) Int. Cl.
*H01R 13/648* (2006.01)

(52) U.S. Cl. ..... 439/607.41; 439/607.58; 439/589

(58) Field of Classification Search ..... 439/607.41, 439/607.58, 588, 589
See application file for complete search history.

(56) References Cited

U.S. PATENT DOCUMENTS 3,702,895 A 11/1972 de Sio
3,805,216 A 4/1974 Gaspar et al.
4,272,148 A 6/1981 Knack, Jr.
4,820,201 A 4/1989 Van Brunt et al.
5,171,161 A 12/1992 Kachlic
5,191,172 A 3/1993 Garganese
5,236,375 A 8/1993 Kachlic
5,777,269 A 7/1998 Handley
5,833,495 A 11/1998 Ito
6,250,963 B1 6/2001 Wright
6,338,644 B1 1/2002 Fritzinger et al.
7,275,960 B2 * 10/2007 Fukushima et al. .... 439/607.15
2008/0188119 A1 * 8/2008 Okamura et al. ..... 439/445

* cited by examiner

*Primary Examiner*—Ross N Gushi
(74) *Attorney, Agent, or Firm*—Thomas N. Twomey

(57) ABSTRACT

A cable connector includes a connector housing attached to an outer shell. A seal is disposed at least partially between the outer shell and the connector housing. A shield is at least partially disposed about the connector housing adjacent to the seal. In one exemplary approach, the connector housing is removably attached to the outer shell. In another exemplary approach, the seal has a unitary configuration.

12 Claims, 4 Drawing Sheets

CABLE CONNECTOR

BACKGROUND

Cable connectors are widely used in various industries to connect two portions of a cable inline with each other or to connect one portion with a header. Cables come in many different sizes and configurations. For example, in a multiple core configuration, each cable has more than one terminal. In a single core configuration, each cable has only one terminal. Often times, cables of these or other configuration must pass through holes of varying sizes and possibly connect to a cable of a different size. Space is often limited in the devices that use such cables, and the cable is often too large to fit through the hole.

The number of components in the cable connector directly affects the size of the cable connector. First, each cable connector includes an outer shell with an integrally formed connector housing, a shield, a shell, and two seals: a peripheral seal and a cable seal. Both seals are enclosed in the cable connector and disposed about the cable. Having both seals increases the number of components, size, and cost of the cable connector. Moreover, integrally forming the connector housing with the outer shell increases the size of the cable connector and limits molding options and material choices. Furthermore, integrally forming the connector housing with the outer shell reduces the effectiveness of a shield because it requires the shield to have additional slots that may fail to prevent unwanted signal leaks.

Accordingly, a cable connector is needed that has a reduced size and cost while still providing a durable and robust cable connection.

SUMMARY

In one exemplary approach, a cable connector includes a connector housing removably attached to an outer shell. A seal is disposed at least partially between the outer shell and the connector housing. A shield is at least partially disposed about the connector housing adjacent to the seal. In another exemplary approach, the seal has unitary configuration.

BRIEF DESCRIPTION OF THE DRAWINGS

The foregoing description will be understood more completely from the following detailed description of the exemplary drawings, in which.

DETAILED DESCRIPTION

A cable connector includes a connector housing, a seal, and a shield disposed within an outer shell. In one embodiment, the seal has a unitary configuration, which enables smaller spacing between cables and significantly reduces the effective surface area that must be sealed to improve connector reliability. Not only does this eliminate the need for peripheral and cable seal retainers, it also reduces the size, number of components, and cost of the cable connector. Moreover, the connector housing is removably attached to the outer shell. Such a configuration reduces the size of the cable connector, increases the effectiveness of the shield by reducing the number of slots needed, and provides greater flexibility in material choice. Accordingly, the resulting cable connector has a smaller size and cost, and is more durable and robust.

Figure 1:
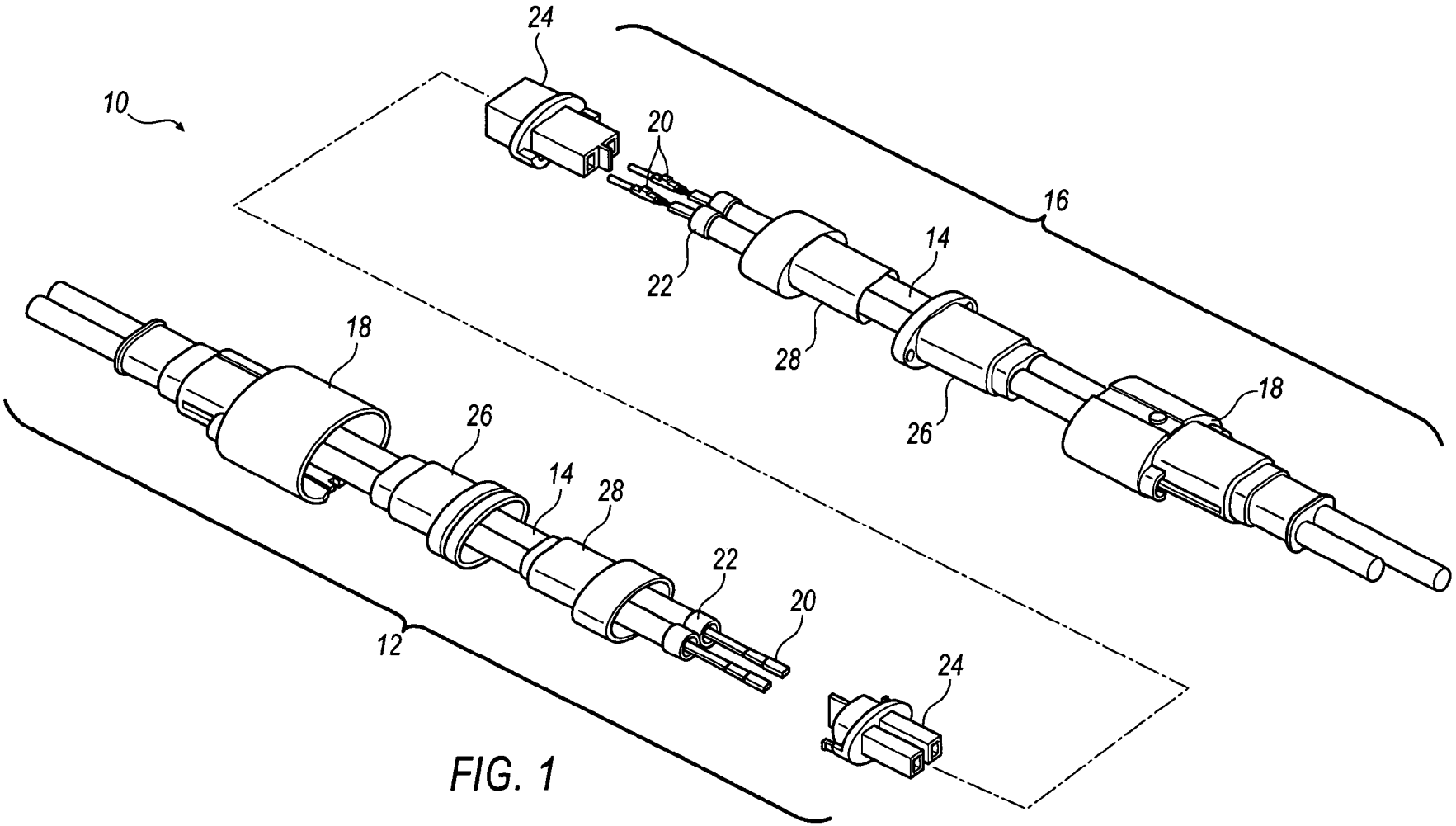
FIG. 1 is an exploded perspective view of a cable having a first portion and a second portion.

FIG. 1 is an exploded perspective view of an exemplary cable connector 10 that electrically connects a first portion 12 of a cable 14 to a second portion 16 of the cable 14. Each portion of the cable 14 has similar components. For example, both portions include an outer shell 18 disposed about and at least partially spaced from the cable 14. Each cable 14 includes at least one terminal 20 and a ferrule 22 crimped about the terminal 20. A connector housing 24 is disposed about the terminal 20 and removably attached to the outer shell 18, as discussed in greater detail below. As illustrated, the connector housing 24 of the first portion 12 has a "female" configuration and the connector housing 24 of the second portion 16 has a "male" configuration. A seal 26 is at least partially disposed between the outer shell 18 and the connector housing 24. In one embodiment, the seal 26 has a unitary configuration, which eliminates the need for separate peripheral seal 26 retainers and cable 14 seal 26 retainers. A shield 28 is at least partially disposed about the connector housing 24 adjacent to the seal 26. The shield 28 prevents other cables 14 or electronic devices from interfering with the cable 14, and vice versa.

Figure 2:
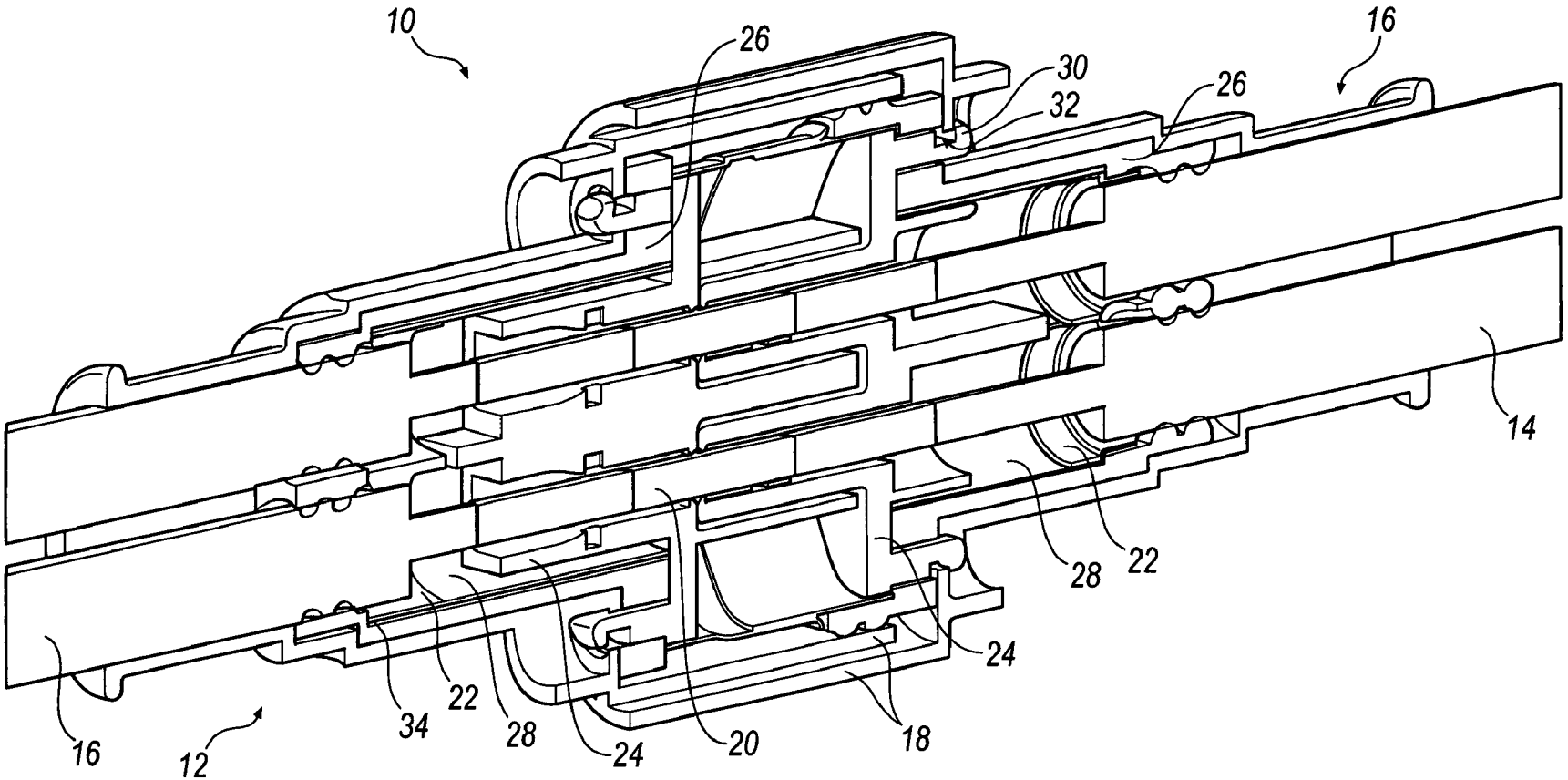
FIG. 2 is a cross-sectional perspective view of the assembled cable connector of FIG. 1 where the first portion is electrically connected to the second portion.

FIG. 2 is an exemplary cross-sectional perspective view of the cable connector 10 where the first portion 12 is electrically connected to the second portion 16. In particular, the outer shell 18 and connector housing 24 of the first portion 12 are slideably disposed within the outer shell 18 and connector housing 24 of the second portion 16, respectively, such that the terminals 20 of each portion are in electrical communication with one another. While the terminals 20 are in electrical communication, power or communication signals may pass freely between the first and second portions 12 and 16 of the cable 14.

As previously discussed, the connector housing 24 is removably attached to the outer shell 18. In one embodiment, each connector housing 24 may include integrally formed clips 30 that snap into recessed portions 32 of the outer shell 18. The clips 30 hold the connector housing 24 onto the outer shell 18 while the first portion 12 is connected to the second portion 16, but the clips 30 have a spring-like characteristic that allows the connector housing 24 to be removed from the outer shell 18 if necessary. This way, the first and second portions 12 and 16 may be disconnected from one another.

The cable connector 10 may further include at least one ferrule stop 34 integrally formed with the outer shell 18. The ferrule stop 34 engages the ferrule 22 to prevent the cables 14 from disconnecting within the cable connector 10. Specifically, the ferrule stop 34 causes the ferrule 22 to bottom out on the shield 28 when the cable 14 is pulled, which provides strain relief and seal protection. Therefore, if one or both of the cables 14 are pulled, the terminals 20 are less likely to disconnect and break the electronic communication between the first and second portions 12 and 16. Accordingly, integrally forming the ferrule stop 34 into the outer shell 18 not only reduces strain on the cable 14, but it provides a more robust and durable cable connector 10.

In the embodiment illustrated in FIGS. 1 and 2, the first and second portions 12 and 16 are inline with one another. However, referring to FIG. 3, instead of forming an inline connection, the cable 14 may be connected to a header 36, which may be mounted to a surface or wall. In one embodiment, the outer shell 18 of the second portion 16 may include the header 36 disposed about the seal 26 and shield 28 of the second portion 16. Accordingly, the header 36 is sealed prior to mating with the first portion 12 and the shield 28 is environmentally protected.

Figure 3:
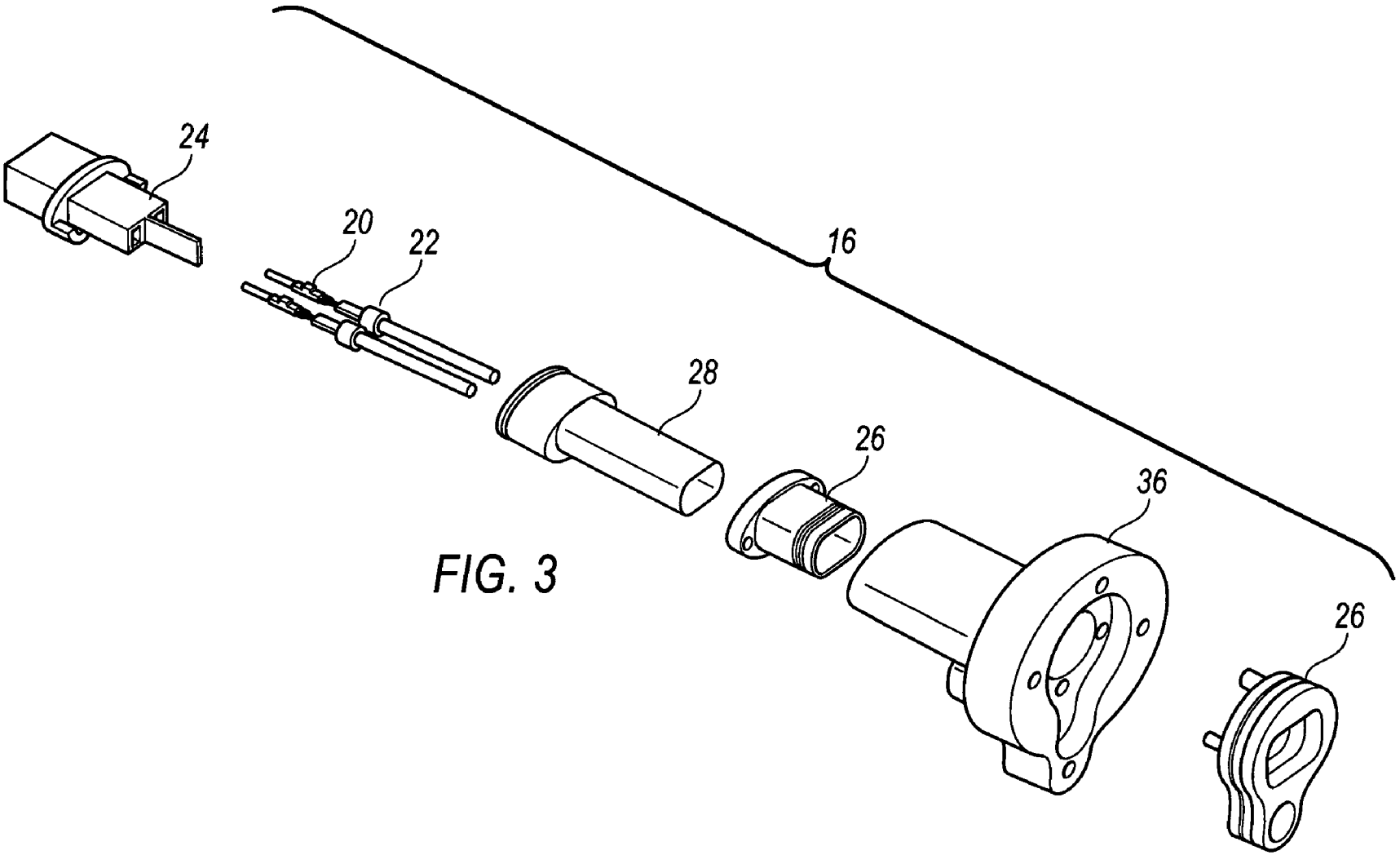
FIG. 3 is an exploded perspective view of the cable connector having a header.

As in the previous embodiment, the seal 26 and shield 28 are disposed about the connector housing 24, and the first portion 12 is electrically connected to the header 36 via their respective connector housings 24. For example, as shown in FIG. 3, the connector housing 24 of the second portion 16 has the "male" configuration that may be slideably disposed about the connector housing 24 of the first portion 12 having the "female" configuration. When the first portion 12 is electrically connected to the header 36, the terminals 20 of the first portion 12 and the terminals 20 disposed within the connector housing 24 of the header 36 are in electrical communication. Furthermore, the terminals 20 disposed in the header 36 provide flexibility for circuit routing inside the controller housing, which can accommodate bus bar technology.

Figure 4:
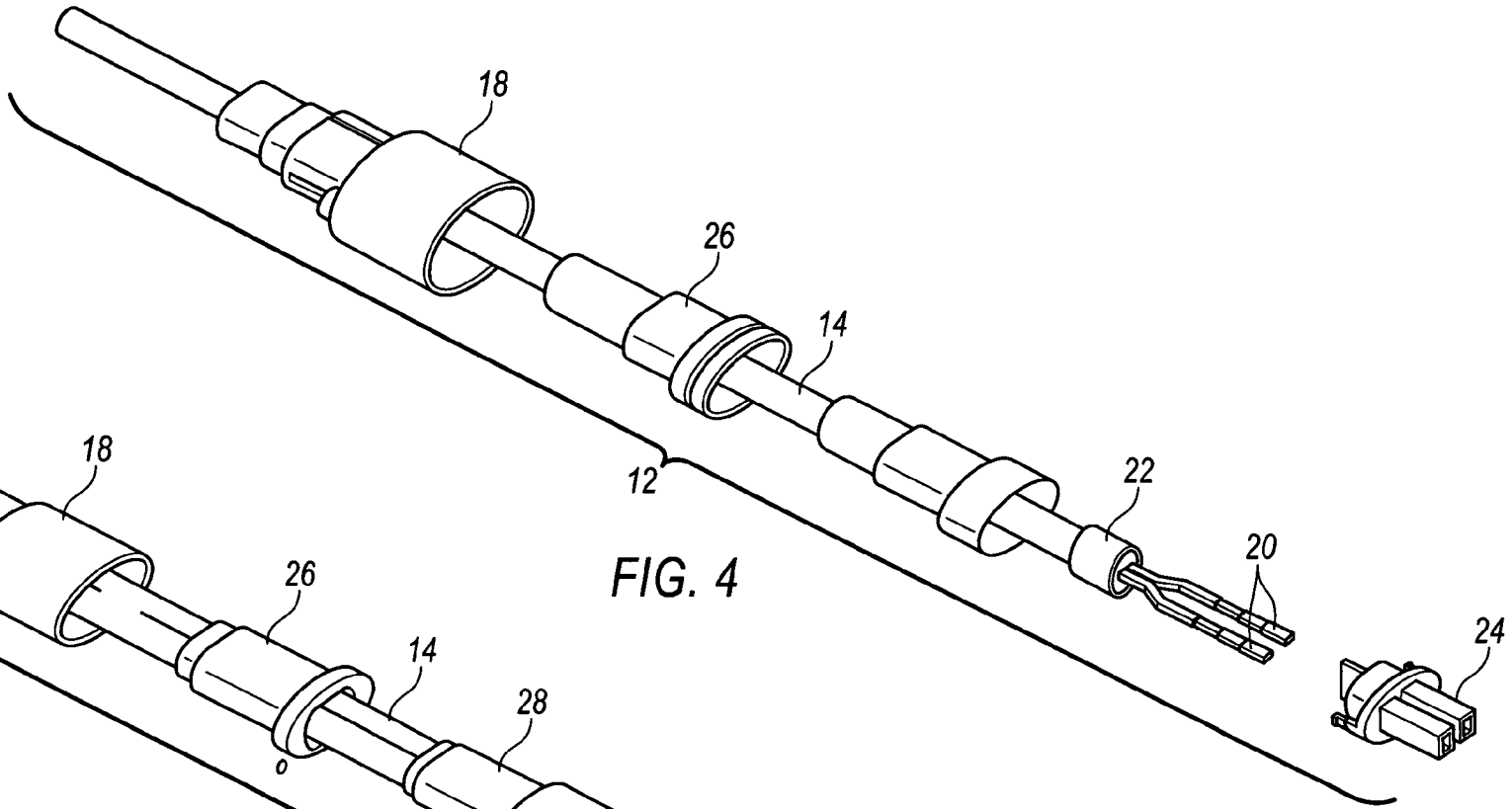
FIG. 4 is an exploded perspective view of the cable connector having a multiple core configuration.
Figure 5:
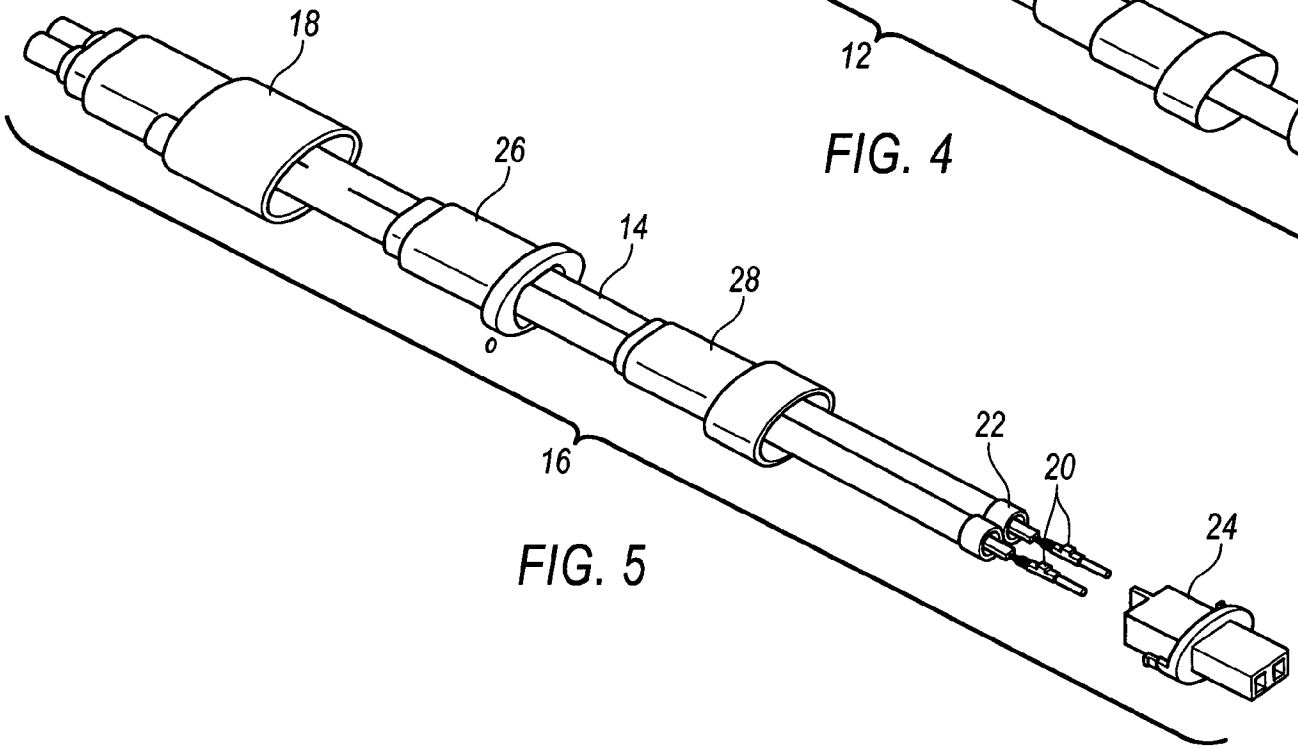
FIG. 5 is an exploded perspective view of the cable connector having a single core configuration.

Referring now to FIGS. 4 and 5, the cable 14 may have a multiple core configuration or a single core configuration. In a multiple core configuration, multiple terminals 20 extend though a single cable 14, and in a single core configuration each cable 14 has a single terminal 20. FIG. 4 is an exemplary view of the cable 14 with a multiple core configuration, and the embodiment illustrated in FIG. 5 shows the cable 14 with the single core configuration.

The above description is intended to be illustrative and not restrictive. Many alternative approaches or applications other than the examples provided would be apparent to those of skill in the art upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future examples. In sum, it should be understood that the invention is capable of modification and variation and is limited only by the following claims.

The present embodiments have been particularly shown and described, which are merely illustrative of the best modes. It should be understood by those skilled in the art that various alternatives to the embodiments described herein may be employed in practicing the claims without departing from the spirit and scope as defined in the following claims. It is intended that the following claims define the scope of the invention and that the method and apparatus within the scope of these claims and their equivalents be covered thereby. This description should be understood to include all novel and non-obvious combinations of elements described herein, and claims may be presented in this or a later application to any novel and non-obvious combination of these elements. Moreover, the foregoing embodiments are illustrative, and no single feature or element is essential to all possible combinations that may be claimed in this or a later application.

All terms used in the claims are intended to be given their broadest reasonable constructions and their ordinary meanings as understood by those skilled in the art unless an explicit indication to the contrary is made herein. In particular, use of the singular articles such as "a," "the," "said," etc. should be read to recite one or more of the indicated elements unless a claim recites an explicit limitation to the contrary.

We claim:

1. A cable connector, comprising:

a first portion having a first outer shell removably attached directly to a first connector housing by integrally formed clips with a first seal disposed therebetween, and a first shield at least partially disposed about said first connector housing; and a second portion having a second outer shell removably attached directly to a second connector housing by integrally formed clips with a second seal disposed therebetween, and a second shield at least partially disposed about said second connector housing;

wherein said first portion is in electrical connection to said second portion.

2. The cable connector as set forth in claim 1, wherein said first outer shell is slideably disposed within said second outer shell and said first connector housing is slideably disposed within said second connector housing.

3. The cable connector as set forth in claim 1, wherein said first portion and said second portion are in-line with one another.

4. The cable connector as set forth in claim 1, wherein said second portion includes a header disposed about at least one of said second seal and said second shield.

5. The cable connector as set forth in claim 1, wherein at least one of said first seal and said second seal has a unitary configuration.

6. The cable connector as set forth in claim 1, further comprising a first terminal disposed in said first connector housing and a second terminal disposed in said second connector housing such that said first terminal and said second terminal are in electrical communication when said first portion is slideably disposed within said second portion.

7. A cable connector, comprising:

a first portion having a first outer shell removably attached to a first connector housing with a first seal disposed therebetween, and a first shield at least partially disposed about said first connector housing adjacent to said first seal; and a second portion having a second outer shell removably attached to a second connector housing with a second seal disposed therebetween, and a second shield at least partially disposed about said second connector housing adjacent to said second seal;

wherein said first portion is in electrical connection to said second portion, and a first cable extending through said first portion and a second cable extending through said second portion.

8. The cable connector as set forth in claim 7, wherein at least one of said first and second cables has a single core configuration.

9. The cable connector as set forth in claim 7, wherein at least one of said first and second cables has a multiple core configuration.

10. A cable connector, comprising:

a first portion having a first outer shell removably attached to a first connector housing with a first seal disposed therebetween, and a first shield at least partially disposed about said first connector housing adjacent to said first seal;

a second portion having a second outer shell removably attached to a second connector housing with a second seal disposed therebetween, and a second shield at least partially disposed about said second connector housing adjacent to said second seal, and said first portion is in electrical connection to said second portion;

a first terminal being disposed in said first connector housing and a second terminal being disposed in said second connector housing such that said first terminal and said second terminal are in electrical communication when said first portion is slideably disposed within said second portion; and a first ferrule being disposed about said first terminal and a second ferrule being disposed about said second terminal.

11. The cable connector as set forth in claim 10, wherein said first ferrule and said second ferrule are crimped onto said first terminal and said second terminal, respectively.

12. A cable connector, comprising:

an outer shell;

a connector housing removably attached to said outer shell;

a seal disposed at least partially between said outer shell and said connector housing;

a shield at least partially disposed about said connector housing adjacent to said seal;

a cable having a terminal disposed in said connector housing; and a ferrule disposed about said terminal, wherein said ferrule is crimped onto said terminal.

* * * * *